United States Patent [19]

Sanchez et al.

[11] Patent Number: 4,761,032

[45] Date of Patent: Aug. 2, 1988

[54] INFANT SEAT COVER

[76] Inventors: Florence J. Sanchez; David L. Sanchez, both of 2381 Second St., LaVerne, Calif. 91750

[21] Appl. No.: 30,509

[22] Filed: Mar. 27, 1987

[51] Int. Cl.[4] ..... A47C 31/10

[52] U.S. Cl. ..... 297/229; 297/184; 297/DIG. 6; 5/498

[58] Field of Search ..... 297/229, 219, 184, DIG. 6; 5/414, 416, 418, 498, 502

[56] References Cited

U.S. PATENT DOCUMENTS

| | | | |
|---|---|---|---|
| 1,770,841 | 7/1930 | Clyman | 5/416 |
| 2,797,743 | 7/1957 | Rodtz | 297/229 |
| 3,078,101 | 2/1963 | Reese | 297/229 |
| 3,580,633 | 5/1971 | Du Priest | 297/184 |
| 3,633,227 | 1/1972 | Tegeler | 5/416 |
| 3,873,117 | 3/1975 | Perego | 297/184 |
| 4,063,319 | 12/1977 | Smith et al. | 5/416 |
| 4,273,380 | 6/1981 | Silvestri | 297/229 |
| 4,413,368 | 11/1983 | Schuetze | 5/502 |
| 4,478,453 | 10/1984 | Schutz | 297/219 |
| 4,546,508 | 10/1985 | Ison | 5/502 |

FOREIGN PATENT DOCUMENTS

| | | | |
|---|---|---|---|
| 794451 | 5/1958 | United Kingdom | 297/219 |

*Primary Examiner*—Francis K. Zugel
*Attorney, Agent, or Firm*—Boniard I. Brown

[57] ABSTRACT

An infant seat cover having a cover pad to be placed over the seat and a blanket and a protective hood attached to the front end and head ends, respectively, of the pad. An article-receiving pocket is attached to the rear of the pad. The blanket may be rolled or otherwise gathered and then tied at the front end of the cover pad when not in use and when needed may be folded back over and adjustably secured along its edges to the pad to cover an infant in the seat in a manner which accommodates the infants's growth. The hood arches over the head end of the pad to shield the infants's head and face against the elements and to some degree against flying glass and other debris in the event of an automobile accident. The hood may be pressed flat against the pad when not in use.

15 Claims, 2 Drawing Sheets

INFANT SEAT COVER

BACKGROUND OF THE INVENTION

1. Field of the Invention

This invention relates generally to infant seats of the kind which are used to support and carry infants in automotive vehicles, the home, and other places. The invention relates more particularly to an improved cover for such infant seats.

2. Discussion of the Prior Art

Infant seats of the kind for which the present seat cover is intended are well known, widely used, and available in a wide variety of designs. In general terms, however, they are all characterized by a cradle-like seat body which forms the seat proper. This seat body has seat and back portions and a supporting base of some type on which the body is mounted. Most seats have restraining means such as straps or the like for securing the infant in the seat.

Infant seats of this kind are commonly used to hold infants in automotive vehicles. In this case, seat is placed on the car seat and secured to the car seat by means of an automobile seat belt. These infant seats are also used to carry an infant from one location to another and to hold an infant in the home, while shopping, and out of doors.

The infant seat body of most infant seats are fabricated of some durable plastic material which may be readily cleaned by wiping the material with a rag or the like. Such materials while durable and sanitary, are not very comfortable to the sensitive skins of infants. Moreover, most infant seat materials become extremely hot to the touch if left exposed to direct sunlight or even when left in an automobile exposed to sunlight.

For this reason, a vast assortment of cloth covers have been devised for infant seats. These covers are commonly fabricated of a soft, durable quilted material which can be washed if desired. The fabrics utilized for such infant seats are commonly very colorful and thus greatly enhance the appearance of the infant seat. One example of such an infant seat cover is disclosed in U.S. Pat. No. 4,478,453.

SUMMARY OF THE INVENTION

This invention provides a novel cover for infant seats of the character described. The cover has a pad to be placed over the infant seat body or seat proper with one end of the pad, herein referred to as its front end, situated adjacent the front edge of the body seat portion, and the other pad end, referred to as its head end, situated adjacent the head end of the seat body back portion. Means such as ties are provided for securing the pad to the seat.

According to one feature of the invention, a blanket is joined to the front end of the pad. This blanket may be folded back over the pad to cover an infant in the seat. When not in use, the blanket may be rolled or otherwise gathered at the front end of the pad and then tied or otherwise secured to keep it out of the way and clean.

According to another feature of the invention, releasible fastening means, such as Velcro fasteners, are provided along the side edges of the pad and blanket for securing the blanket to the pad in a manner to form a pocket in effect for receiving the infant's legs and body. These releasible fastening means permit adjustable attachment of the blanket to the pad in a way which enables the depth of the pocket to be adjusted to accommodate the infant's growth. The blanket may have a pocket for containing a removable blanket layer to permit the blanket thickness and hence its effective warming ability, to be varied, depending upon the air temperature.

Another feature of the invention resides in a protective hood, with a visor if desired, secured to the head end of the cover pad. This hood arches over the pad to shield the infant's head and face against the elements. The hood also shields to some degree the infant's face against flying glass and other debris in the event of an automobile accident. The hood may be flexible to permit the hood to be retracted in effect by depressing the hood flat against the pad.

The preferred pad has a rear panel joined to the pad and forming with the pad a pocket for receiving the head end of the seat body support to hold the seat cover to the body support. An article receiving pocket is secured to this panel.

DETAILED DESCRIPTION OF THE INVENTION

Figure 1:
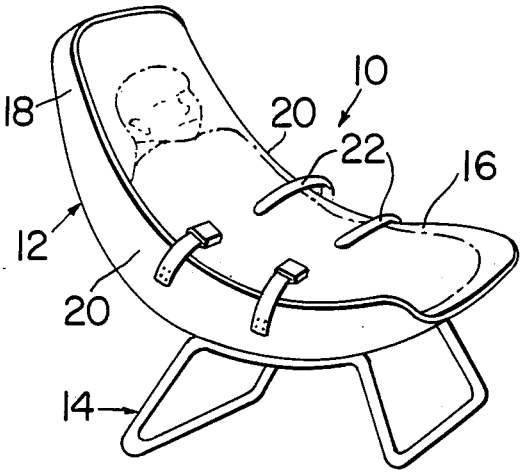
FIG. 1 (PRIOR ART)
FIG. 1 is a perspective view of a conventional infant seat, illustrating in broken lines the position occupied by an infant in the seat.
Figure 2:
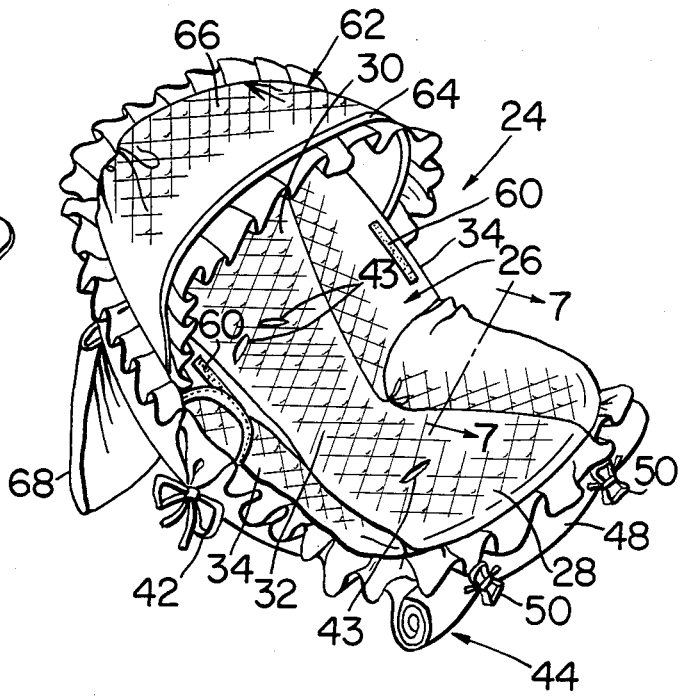
FIG. 2 is a perspective view of the seat in FIG. 1 covered by a seat cover according to this invention with a blanket of the cover rolled up and tied.
Figure 3:
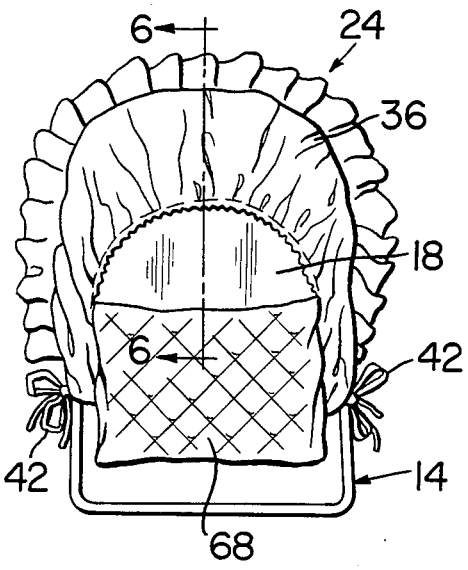
FIG. 3 is a rear view of the covered seat in FIG. 2.
Figure 4:
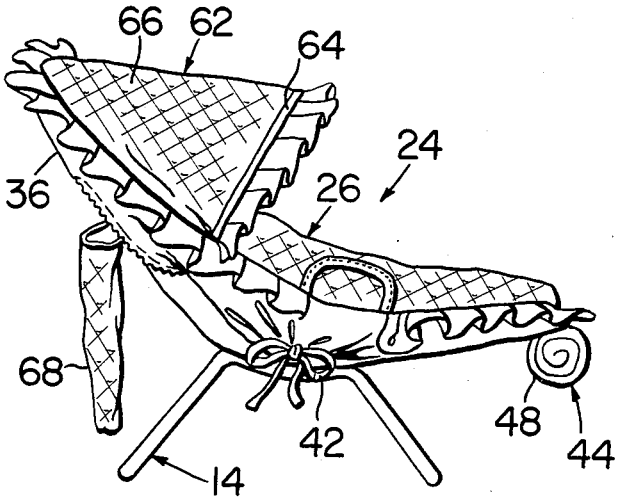
FIG. 4 is a side elevation of the covered seat in FIG. 2.
Figure 5:
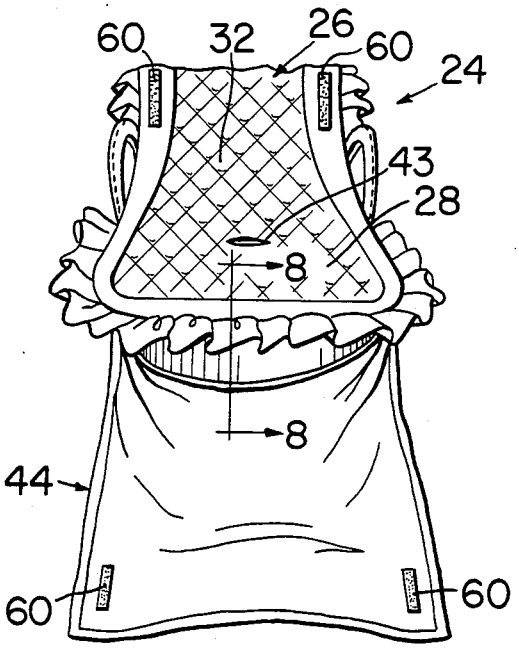
FIG. 5 is a fragmentary front view of the covered seat with the blanket unrolled for clarity.
Figure 6:
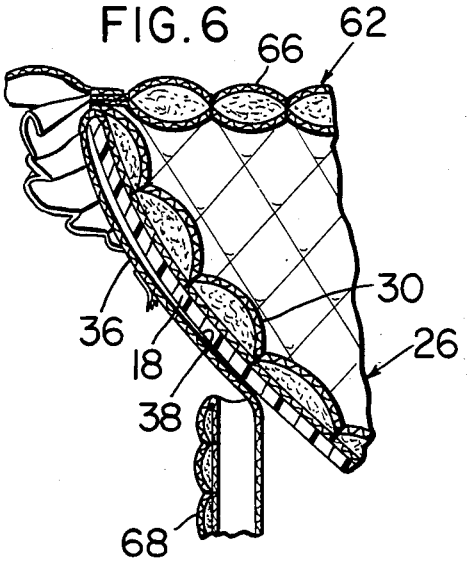
FIG. 6 is an enlarged section taken on line 6—6 in FIG. 3.
Figure 7:
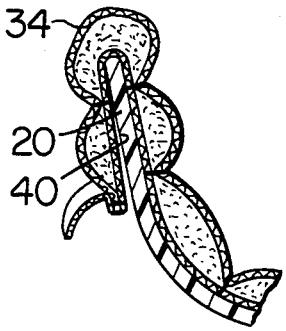
FIG. 7 is an enlarged section taken on line 7—7 in FIG. 2.
Figure 8:
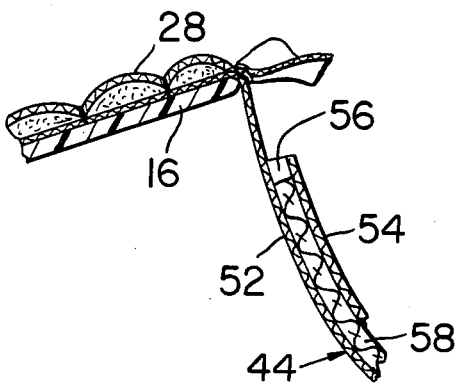
FIG. 8 is an enlarged section taken on line 8—8 in FIG. 5.

Referring first to FIG. 1 of these drawings, the illustrated infant seat 10 is conventional and includes a generally seat-like body 12 which forms the seat proper and a supporting base 14 for the body. The seat body 12 has a seat portion 16, an upstanding back portion 18, and upturned longitudinal side walls 20. The seat body 12 may be molded from plastic or otherwise fabricated from different material. Since the infant seat is conventional, further description of the seat is not necessary except to say that an infant is placed in the seat body 12 in the position shown in broken lines and is secure to the seat by straps 22 attached to the seat body.

For the reasons of comfort mentioned earlier, it is desirable to cover the infant seat body 12 with a soft fabric. FIGS. 2–5 illustrate a soft fabric seat cover 24 according to the present invention applied to the infant seat 10.

Infant seat cover 24 comprises a pad 26, preferably a soft quilted pad, to be placed over the seat body 12 with one end 28 of the pad, referred to herein as its front or foot end, situated adjacent the front edge of the seat portion 16 of the infant seat and the opposite end 30 of the pad, referred to as its head end, situated adjacent the upper edge of the seat body back portion 18. The cover pad 26 has a bottom panel 32 which covers the seat and back portions 16, 18 of the seat body 12 and sidewall portions 34 which cover the seat body side walls 20.

At the rear of the cover pad 26 is a panel 36 which is secured along its top and side edges to the top and side edges of the cover pad 26 to form, with the pad head and side wall portions 30, 34, pockets 38 and 40 for receiving the upper end of the seat body back portion 18 and seat body side walls 20, respectively. The pad 26 is placed over the seat body 12 with the upper end of its upstanding back portion 18 and the body side walls 20 fitting within the pad pockets 38, 40, respectively. The pad may be fastened by ties 42 to the seat body. The bottom panel 32 of the pad has openings 43 through which the seat straps 22 may extend.

Joined at one end to the front end 28 of the cover pad panel 32 is a blanket 44. This blanket may be folded back over the cover pad 26, to cover an infant placed in the seat. When not in use, the blanket may be gathered and tied at the front end of the pad to keep the blanket out of the way and clean. In the drawings, for example, the blanket is rolled into a blanket roll 48 and secured by ties 50.

The blanket 44 may comprise a single layer. Preferably, however, the blanket comprises two panels or layers 52, 54 joined along their side edges and one end edge to form a pocket 56 containing a removable blanket layer 58. The pocket 56 has an open end adjacent the front end 28 of the cover pad 26 through which the blanket layer 58 may be removed from and inserted into the pocket 56. The effective thickness or weight of the blanket may thus be varied in accordance with the outside air temperature.

According to a preferred feature of the invention, the cover pad 26 and blanket 44 have coacting releasible fastening means 60 along their side edges for securing the blanket to the pad when the blanket is folded over the pad to cover the infant. The preferred fastening means are Velcro strips. When the blanket is thus secured to the pad, the pad and blanket effectively form a sleeping-bag-like pocket for receiving the infant's legs and body. The fastening means 60 are arranged, as by providing elongate Velcro strips on either or both the pad and blanket to permit the blanket to be secured to the pad in various positions along the pad and/or blanket in such a way as to effectively vary the depth of the pocket in accordance with the size of the infant. If desired, the fastening means 60 may be arranged to secure and seal the blanket to the pad along virtually the full length of their confronting side edges.

According to another feature of the invention, the seat cover 24 includes a protective hood 62 secured to the upper or head end of the cover pad 26 along the side and upper edges of the pad. This hood arches over the head end of the pad to shield the infant's head and face against wind and sun, as well as rain. Moreover, the hood provides some protection to the infant's head and face against flying glass and other debris which occur during an automobile accident. The hood 62 comprises a flexible hoop 64 attached at its ends to opposite sides of and arching over the cover pad 26 and a fabric, preferably quilted, panel 66 joined to the hoop along one edge and to the pad 26 along its top and side edges. The hoop 64 retains the hood 62 over the head end of the pad 26 but may be pressed toward and against the pad to flatten the hood against the pad when the hood is not required. Thus, the hood is effectively retractable when not in use. Obviously, the hood could be made retractable in other ways, as by pivotally attaching the ends of the hoop 64 to the pad 26 in a manner such that hoop could be rotated upwardly and rearwardly against the pad.

For convenience, an article receiving pocket 68 is provided at the rear of the seat cover 24. This pocket is secured to and hangs downwardly from the rear cover panel 36.

The inventor claims:

1. A cover for an infant seat including a relatively rigid infant body support having a seat portion with a front end, a back portion with an upper end, and upstanding side walls along the longitudinal sides of said seat and back portions, said cover comprising:

a pad having front and rear sides opposite head and foot ends, and longitudinal side wall portions for covering said body support with said foot end of the pad located adjacent the front end of said body support seat portion, the head end of the pad located adjacent the upper end of said body support back portion, and said side wall portions of the pad overlying said body support side walls, a panel at the rear side of said pad and joined to the pad along its head end and longitudinal sides and forming with and at the rear of the pad a head end pocket for receiving the upper end of the infant seat back portion and longitudinal side pockets for receiving the infant side walls, and a blanket joined at one end to said foot end of said pad and adapted to be folded back over the pad for covering an infant positioned in the body support and gathered at the foot end of the pad to uncover the infant.

2. An infant seat cover according to claim 1, wherein:

said cover includes means for retaining the blanket in its gathered condition.

3. An infant seat cover according to claim 2, wherein:

said blanket retaining means comprises a blanket tie.

4. An infant seat cover according to claim 1, wherein:

said blanket is adapted to be rolled into a blanket roll at the foot end of said pad, and said cover includes means for retaining the blanket in its rolled condition.

5. An infant seat cover according to claim 4, wherein:

said blanket retaining means comprises a tie for encircling the blanket roll.

6. An infant seat cover according to claim 1, wherein:

said blanket has longitudinal edges, and coacting releasible fastening means along said pad side wall portions and said blanket edges for releasibly securing said blanket edges to the pad.

7. An infant seat cover according to claim 6, wherein:

said blanket is foldable over said pad to form a pocket to receive the infant's body, and said fastening means permit said blanket edges to be secured to said pad in a range of positions lengthwise of the pad, thereby to accommodate the depth of said pocket to the length of the infant

8. An infant seat cover according to claim 7, wherein:

said fastening means comprise VELCRO fasteners.

9. An infant seat cover according to claim 1, wherein:

said blanket comprises an envelope for receiving an additional thermal insulating member and having an opening through which the insulating member may be inserted into and removed from.

10. An infant seat cover according to claim 8, wherein:

said blanket comprises an envelope for receiving an additional thermal insulating member.

11. An infant seat cover according to claim 1, including:

a hood including a flexible hoop joined to opposite longitudinal sides of said pad adjacent its head end in such a way that the hood may be disposed with the hood arching over the head end of the pad to overlie the infant's head and face and the hood may be pressed against the pad to uncover the infant.

12. In combination:

an infant seat including a relatively rigid infant body support having a seat portion with a front end, a back portion with an upper end, and upstanding side walls along the longitudinal sides of said seat and back portions, a pad head and foot ends and longitudinal side wall portions and covering said body support with said foot end of the pad located adjacent the front end of said body support seat portion, the head end of the pad located adjacent the upper end of said body support back portion, and said side wall portions of the pad overlying said body support side walls, a panel at the rear side of said pad and joined to the pad along its head end and longitudinal sides forming with and at the rear of the pad a head end pocket receiving the upper end of the infant seat back portion and longitudinal side pockets receiving the infant seat side walls, and a blanket joined at one end to said foot end of said pad and adapted to be folded back over the pad for covering an infant positioned in the body support and gathered at the foot end of the pad to uncover the infant.

13. The combination of claim 12, wherein:

said cover includes means for retaining the blanket in its gathered condition.

14. The combination of claim 12, wherein:

said blanket has longitudinal edges, and coacting releasible fastening means along said pad side wall portions and said blanket edges for releasibly securing said blanket edges to the pad.

15. The combination of claim 12, including:

a hood including a flexible hoop joined to opposite longitudinal sides of said pad adjacent its head end in such a way that the hood may be disposed with the hood arching over the head end of the pad to overlie the infant's head and face and the hood may be pressed against the pad to uncover the infant.

* * * * *